US006883760B2

(12) United States Patent
Seise, Jr.

(10) Patent No.: US 6,883,760 B2
(45) Date of Patent: Apr. 26, 2005

(54) RAIN GUTTER COVER SYSTEM

(76) Inventor: John W. Seise, Jr., 4700 NW. Linden Rd., Kansas City, MO (US) 64151

( * ) Notice: Subject to any disclaimer, the term of this patent is extended or adjusted under 35 U.S.C. 154(b) by 0 days.

(21) Appl. No.: 10/456,289

(22) Filed: Jun. 6, 2003

(65) Prior Publication Data

US 2004/0244303 A1 Dec. 9, 2004

(51) Int. Cl.[7] ..... E04D 13/64
(52) U.S. Cl. ..... 248/48.1; 52/12; 210/474
(58) Field of Search ..... 52/12, 11, 13, 52/14, 16; 248/48.1, 48.2; 210/473, 474

(56) References Cited

U.S. PATENT DOCUMENTS

| | | | | | |
|---|---|---|---|---|---|
| 4,727,689 | A | * | 3/1988 | Bosler | 52/12 |
| 4,745,710 | A | * | 5/1988 | Davis | 52/12 |
| 4,937,986 | A | * | 7/1990 | Way et al. | 52/12 |
| 5,471,798 | A | * | 12/1995 | Kuhns | 52/12 |
| 5,640,810 | A | * | 6/1997 | Pietersen | 52/12 |
| 5,813,173 | A | * | 9/1998 | Way, Sr. | 52/12 |
| 6,016,631 | A | * | 1/2000 | Lowrie, III | 52/12 |
| 6,151,837 | A | * | 11/2000 | Ealer, Sr. | 52/12 |
| 6,688,045 | B1 | * | 2/2004 | Pilcher | 52/12 |

OTHER PUBLICATIONS

Prior art rain gutter cover system commercially available under the designation Englert Leaf Guard as shown in the printout from the website www.leafguard.com attached as Exhibit A (printed Jun. 24, 2003).

Prior art gutter filter commercially available under the designation Shearflow from LB Plastics, Inc. as shown in the printout from the website www.lbplastics.com and the photograph attached as Exhibits B (printed Jun. 24, 2003) and C respectively.

Prior art solid gutter cover commercially available under the designation Solid Gutter Cover from Gutter World as shown in the printout from the website www.gutterworld.com and the photograph attached as Exhibits D (printed Jun. 24, 2003) and E respectively.

Prior art hinged gutter guards commercially available under the designation Premium Hinged Gutter Guards from Gutter World as shown in the printout from the website www.gutterworld.com and the photograph attached as Exhibits F (printed Jun. 24, 2003) and G respectively.

(Continued)

*Primary Examiner*—Leslie A. Braun
*Assistant Examiner*—Tan Le
(74) *Attorney, Agent, or Firm*—Hovey Williams LLP

(57) ABSTRACT

A rain gutter cover system (10) constructed in accordance with the principles of a preferred embodiment of the present invention is disclosed. The system (10) is configured for directably collecting rain water running off of the roof (R) of a building (B) while substantially preventing undesired debris from entering the gutter (16). The system (10) broadly includes a gutter assembly (12) and a cover assembly (14) coupled to, and covering, the gutter assembly (12). The cover assembly (14) includes a one piece screen (20) and a plurality of fluted perforations (22) formed in the screen (20). The fluted perforations (22) are each particularly configured to draw water through the screen (20) without allowing undesired debris through the screen (20) and each includes a channel (40) recessed into the screen (20) and a corresponding hole (42) defined in the downhill end of the channel (40). A valley segment (210) of the system is also disclosed and includes a plurality of bull-nose ledges (212, 214, 216, 218 and 220), each guarding a plurality of fluted perforations (222) along the valley of a roof.

16 Claims, 5 Drawing Sheets

OTHER PUBLICATIONS

Prior art snap–in gutter guards commercially available under the designation Plastic Snap–in Gutter Guards from Gutter World as shown in the printout from the website www.gutterworld.com and the photograph attached as Exhibits H (printed Jun. 24, 2003) and I respectively.

Prior art lock on gutter guards commercially available under the designation LOCK–ON Gutter Guard from Gutter World as shown in the printout from the website www.gutterworld.com and the photograph attached as Exhibits J (printed Jun. 24, 2003) and K respectively.

Prior art drop in gutter guards commercially available under the designation DROP–IN Gutter Guard from Gutter World as shown in the printout from the website www.gutterworld.com attached as Exhibit L (printed Jun. 24, 2003).

Prior art gutter guard as shown in the photographs attached as Exhibits M and N.

* cited by examiner

RAIN GUTTER COVER SYSTEM

BACKGROUND OF THE INVENTION

1. Field of the Invention

The present invention relates generally to guttering systems for collecting rain water running off a building's roof and directing the water away from the roof. More specifically, the present invention concerns a rain gutter cover system that enables the gutter to collect and direct the rain water while simultaneously preventing undesired debris from entering the gutter. The inventive cover system includes a plurality of unique fluted perforations for siphoning water through the system and into the gutter while screening out debris. In a preferred embodiment, the cover system includes a plurality of bull-nosed ledges that guard the fluted perforations, including a ledge running adjacent the roofline, as well as a plurality of ledges running transverse along the valleys of the roof.

2. Discussion of Prior Art

Gutters for collecting rain water running off of a roof are known in the art. These gutters are typically U-shaped troughs open at their upper-most end that are affixed under the lower most edges of the roof and extend along the roofline to collect water that is running off of the roof. Prior art gutters are typically formed of aluminum and are anchored to the eaves of the building by metal spikes or hangers. The gutters are sloped slightly to direct the water into a connected down spout that in turn directs the water to a desired spill way or drainage area that drains the water away from the building's foundation. However, these prior art guttering systems are undesirably prone to collecting undesired debris such as foliage, trash, animal excrement and remains, toys, etc. Such debris often accumulates at bottle neck points along the guttering system, such as around the spikes or hangers, at the drop outlets to the down spouts, at bends in the gutters and/or down spouts, etc. Debris accumulation can become built up to the point that the guttering system no longer adequately drains water. Debris accumulation is also particularly problematic in gutters under a valley in the roof (e.g., where two differing slopes intersect, etc.) because the valleys tend to collect debris and drain it into the gutter below the valley. As a result, water undesirably accumulates in the gutters where it can run over the sides to an unwanted location, leak into the building, cause rot and/or rust damage to the building and/or guttering, and/or overload the gutters thereby pulling the gutters out of a proper working orientation.

It is known in the art to cover the gutter with a screen in an attempt to prevent debris from entering the gutter. It is also known in the art to cover at least a portion of the gutter with a non-permeable covering, or helmet, that narrows the ingress for water to thereby block larger debris from entering the gutter. These prior art cover systems are problematic and suffer from several undesirable limitations. For example, the prior art screens are particularly susceptible to debris becoming lodged in the grid openings, which in turn accumulates further debris thus compromising the ability of water to sufficiently drain into the guttering system. The prior art covers enable smaller debris to enter the guttering system, which in turn can accumulate in the gutters and down spouts thereby clogging the guttering system. Additionally, these prior art cover systems are particularly susceptible to animals building nests in and around the cover systems thereby undermining the systems' efficacy. Furthermore, heretofore, none of the prior art cover systems have addressed the problem of relatively large debris accumulation in and around the valleys in a roof, and even the most effective prior art cover systems become compromised by heavy debris accumulation beneath a valley.

SUMMARY OF THE INVENTION

The present invention provides an improved rain gutter cover system that does not suffer from the problems and limitations of the prior art cover systems detailed above. The inventive cover system provides a plurality of unique fluted perforations that effectively siphon large amounts of water into the gutter yet are configured to substantially prevent undesired debris from entering the gutter. In a preferred embodiment, the fluted perforations are the only means of water entering the guttering system and are all guarded by bull-nosed ledges adjacent the roofline, as well as a plurality of ledges running transverse along the valleys of the roof.

A first aspect of the present invention concerns a rain gutter cover system for directing water running off a building's roof into a gutter extending along the roofline while simultaneously preventing undesired debris from entering the gutter. The system broadly includes a screen adapted to couple to the gutter and being operable to extend from the roofline over the gutter in a covering relationship when the screen is coupled to the gutter so that substantially all water entering the gutter must pass through the screen. The screen includes at least one section sloping downhill between the roofline and the gutter. The screen includes a plurality of perforations formed therein for siphoning water through the screen and into the gutter. The perforations comprise the only means for water to pass through the screen. Each perforation includes a channel formed in the screen adjacent the perforation on the uphill side of the perforation for channeling water into the perforation. At least a portion of the plurality of perforations are formed in the at least one section.

A second aspect of the present invention concerns a valley cover system for directing water running along a trough formed between two slopes in a building's roof wherein the trough extends from a ridge to a roofline and wherein the cover system directs the water into a gutter extending along the roofline while simultaneously preventing undesired debris from entering the gutter. The system broadly includes a screen adapted to couple to the gutter and being operable to extend from the gutter over the roofline and at least partially along the trough in a covering relationship when the screen is coupled to the gutter so that substantially all water running from the trough into the gutter must pass through the screen. The screen includes at least one section overlying the trough and being defined between the roofline and the ridge when the screen is coupled to the gutter. The screen includes a plurality of perforations formed therein for siphoning water through the screen and into the gutter. The perforations comprise the only means for water to pass through the screen. At least a portion of the plurality of perforations are formed in the at least one section.

A third aspect of the present invention concerns a rain guttering system for directing water running off a building's roof wherein the roof defines a lower-most roofline. The system broadly includes a generally U-shaped gutter adapted to couple under, and extend along the roofline for directably collecting the water running off of the roof, and a screen assembly coupled to the gutter and being operable to generally prevent undesired debris from entering the gutter. The screen assembly generally slopes downward and extending over the roofline and the gutter in a covering relationship therewith so that substantially all water entering the gutter must pass through the screen. The screen includes a plurality of perforations formed therein for siphoning water through the screen and into the gutter. The perforations comprise the only means for water to pass through the screen. Each perforation includes a channel formed in the screen adjacent the perforation on the uphill side of the perforation for channeling water into the perforation.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figures 2, 3, 9:
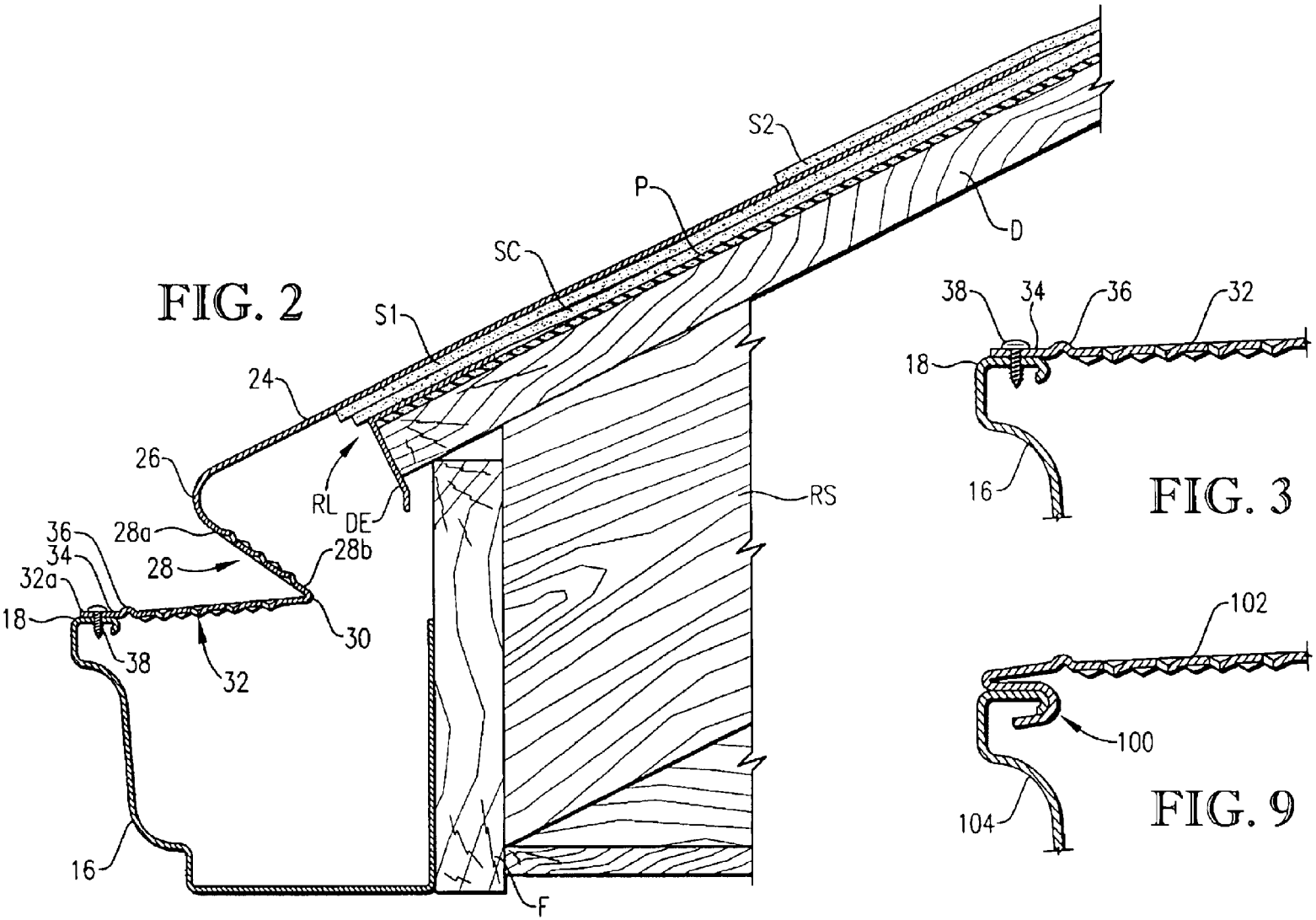
FIG. 2 is a longitudinal sectional view of the rain gutter cover system illustrated in FIG. 1, illustrating the location of the fluted perforations and the bull-nose ledge guarding the perforations.
FIG. 3 is a fragmentary sectional view of the rain gutter cover system illustrated in FIGS. 1 and 2, illustrating the interconnection between the cover assembly and the gutter assembly.
Figures 4, 5, 7:
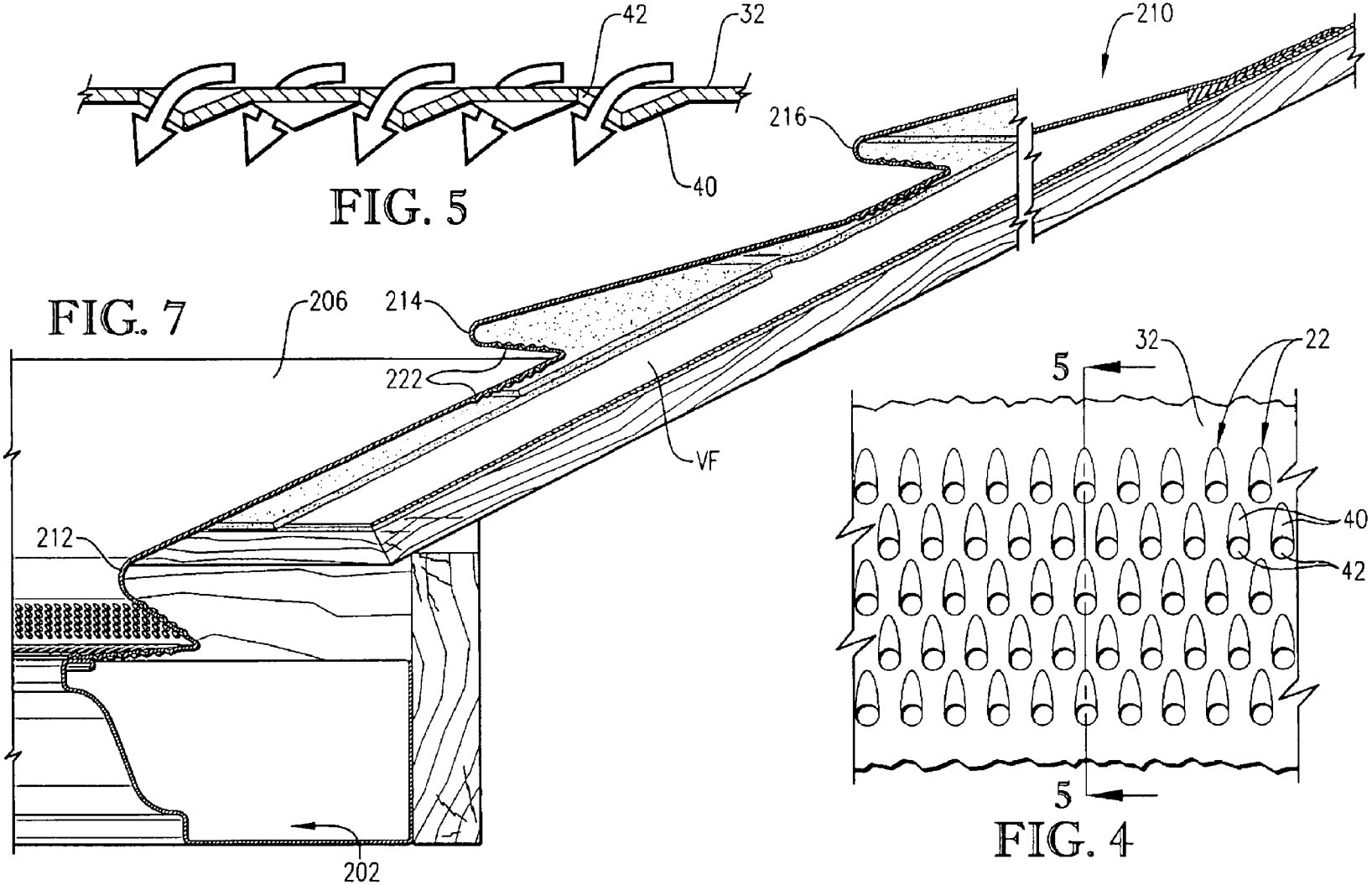
FIG. 4 is an enlarged fragmentary view of the rain gutter cover system illustrated in FIGS. 1–3, particularly illustrating the fluted perforations.
FIG. 5 is a greatly enlarged sectional view of the rain gutter cover system taken substantially along line 5—5 of FIG. 4 shown with arrows indicating the direction of fluid flow through the fluted perforations.
Figure 6:
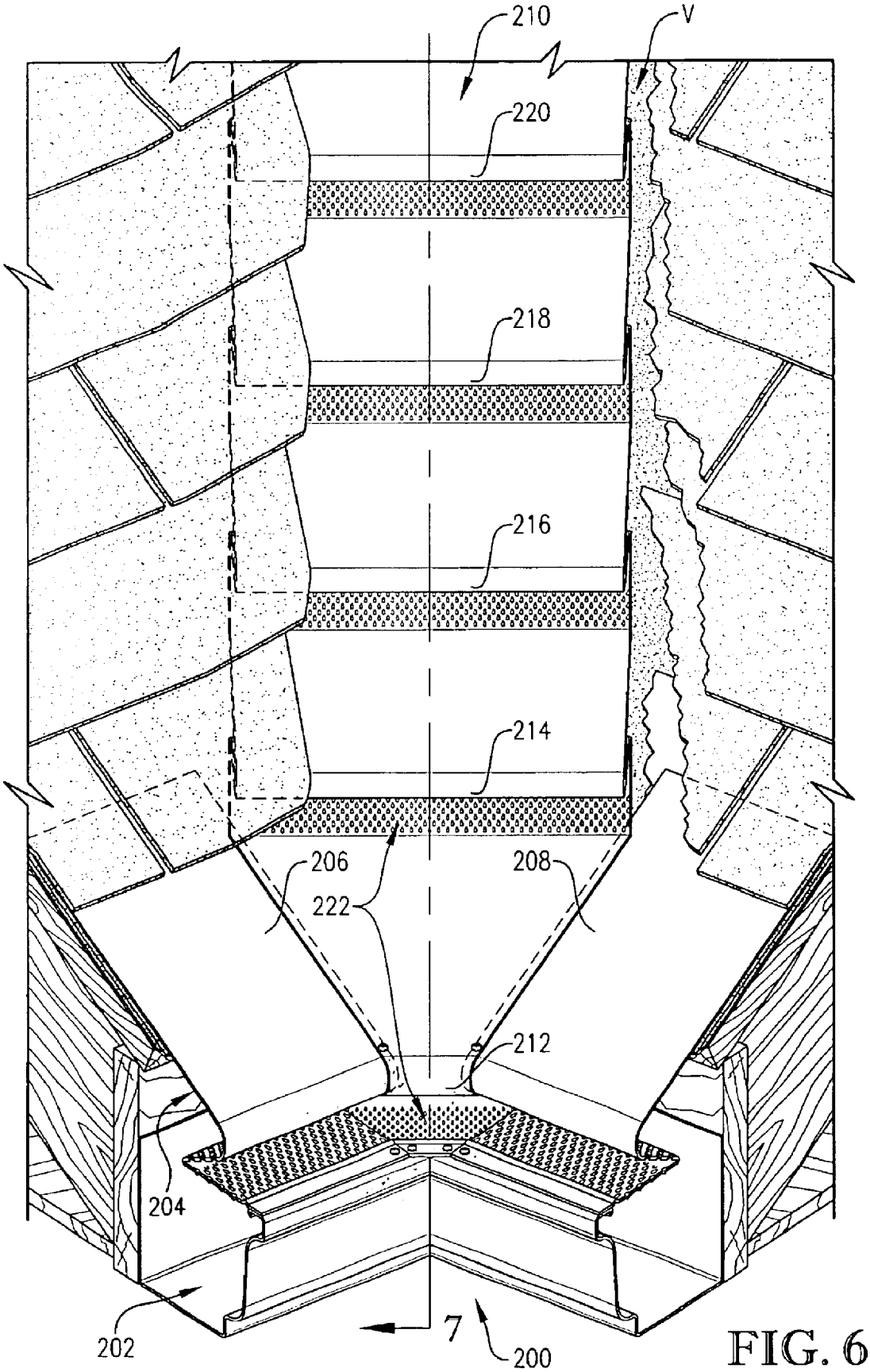
Figure 8:
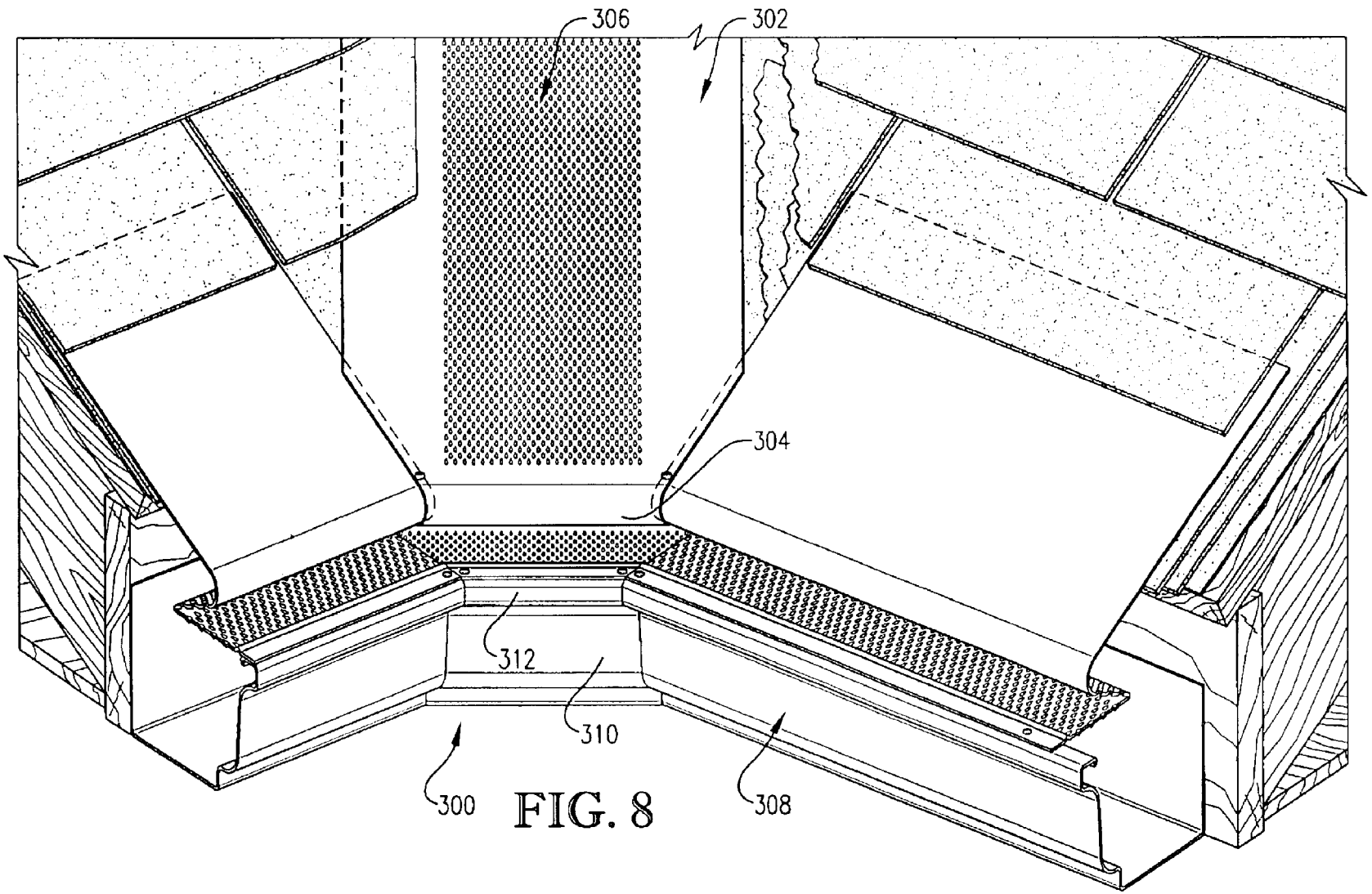

FIG. 6 is a perspective view of a segment of a rain gutter cover system constructed in accordance with the principles of a preferred alternative embodiment of the present invention and shown with the gutter assembly affixed to adjoining eaves at the corner of a building (shown in fragmentary) and the multiple-ledged cover assembly extending over the gutter, the building's lower-most roofline, and the valley formed between two adjoining slopes in the building's roof;

FIG. 7 is an enlarged sectional view of the rain gutter cover system taken substantially along line 7—7 of FIG. 6, illustrating the location of the fluted perforations and the plurality of bull-nose ledges guarding the perforations;

FIG. 8 is a perspective view of a segment of a rain gutter cover system constructed in accordance with the principles of a second preferred alternative embodiment of the present invention and shown with the miter-boxed gutter assembly affixed to adjoining eaves at the corner of a building (shown in fragmentary) and the single-ledged cover assembly extending over the gutter, the building's lower-most roofline, and the valley formed between two adjoining slopes in the building's roof; and FIG. 9 is a fragmentary sectional view of a segment of a rain gutter cover system constructed in accordance with the principles of a third preferred alternative embodiment of the present invention, particularly illustrating an alternative interconnection between the cover assembly and the gutter assembly.

DETAILED DESCRIPTION OF THE PREFERRED EMBODIMENTS

Figure 1:
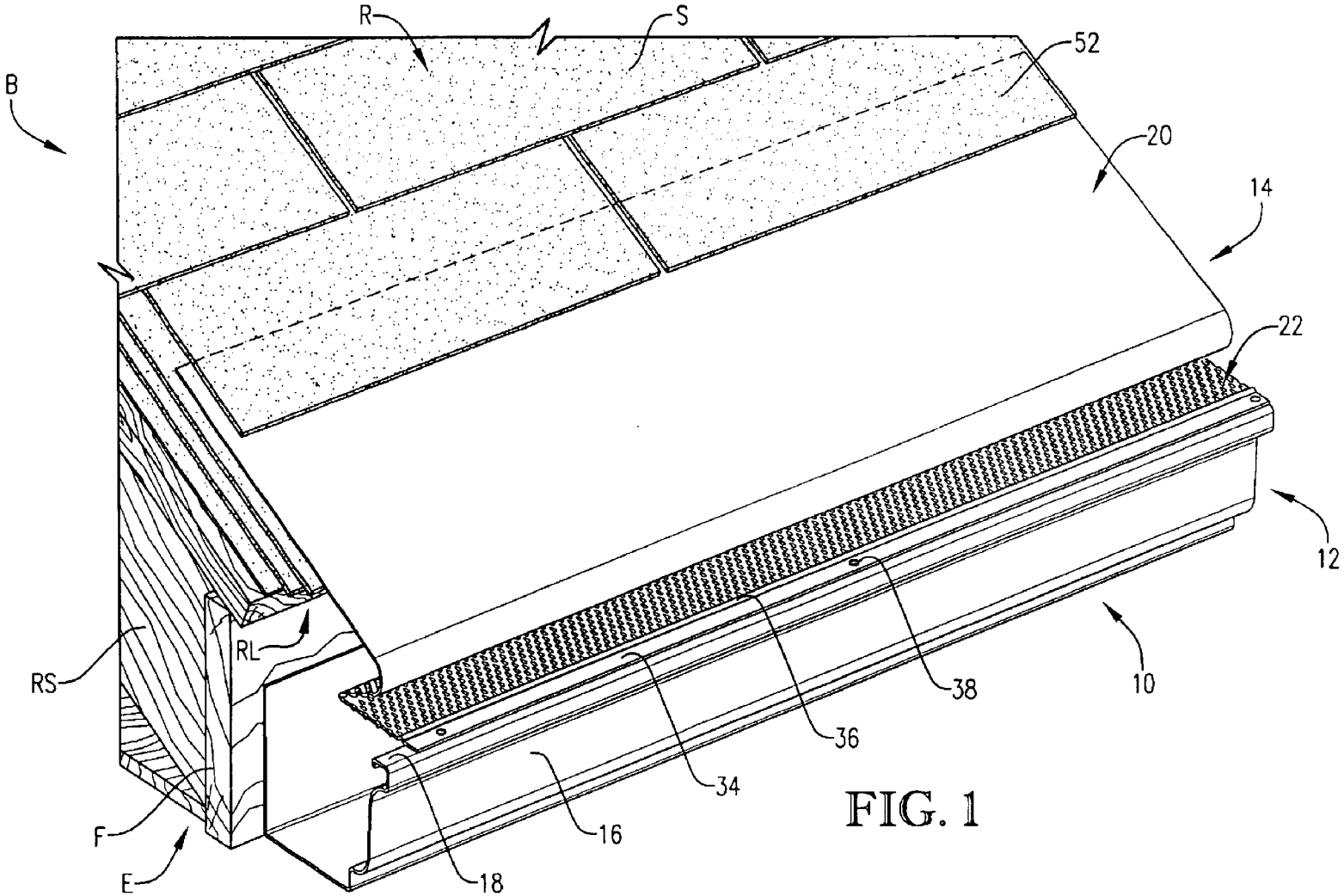
FIG. 1 is a perspective view of a segment of a rain gutter cover system constructed in accordance with the principles of a preferred embodiment of the present invention and shown with the gutter assembly affixed to the cave of a building (shown in fragmentary) and the cover assembly extending over the gutter and the building's lower-most roofline and under the roofs second course of shingles.

FIG. 1 illustrates a segment of a rain gutter cover system 10 constructed in accordance with the principles of a preferred embodiment of the present invention and configured for directably collecting rain water running off of the roof R of a building B while substantially preventing undesired debris from entering the gutter. The illustrated system 10 is shown affixed to a conventional composite roof commonly utilized on residential houses. In one manner well known in the art, the illustrated building B presents a plurality of sloping rafters RS that define an eave E overhanging an exterior wall (not shown). A fascia board F is coupled along the lower-most ends of the rafters RS. The roof R of the building B is supported on the sloping rafters RS and includes a layer of decking D, a layer of tar paper P, a drip edge DE, and overlapping courses of shingles S—including a starter course SC, a first course of shingles S1, and a second course of shingles S2 (see FIGS. 1 and 2). The multiple layered roof R generally defines a lower-most roofline RL that extends out over the fascia board F (see FIG. 2). Although the system 10 is shown with a composite roof on a residential home for illustrative purposes, the principles of the present invention are not limited to any particular type of building, or any particular style of roof, and can equally be applied to virtually any style of roof (e.g., composite, wood, slate, etc.) on virtually any type of building (e.g., residential, commercial, etc.) wherein it is desired to collect rain water running off of the roof while generally preventing undesired debris from accumulating in the guttering system. The illustrated rain gutter cover system 10 broadly includes a gutter assembly 12 and a cover assembly 14 coupled to, and covering, the gutter assembly 12.

In more detail, and turning to FIGS. 1 and 2, in one manner known in the art, the gutter assembly 12 includes a generally U-shaped gutter 16, or trough, that is open at its upper end. The gutter 16 is fixed to the fascia board F in any suitable manner, such as with spikes or hangers (not shown). The gutter 16 is positioned under, and extends along the roofline RL for collecting rain water running off of the roof R. For purposes that will subsequently be described, the gutter 16 defines an upper, generally flat surface 18 extending along the outside edge of the gutter 16. The illustrated gutter 16 could be formed of any suitable, weather-protected material, such as aluminum, vinyl, etc. The gutter 16 is preferably configured to hold water contained therein without leaking and is at least slightly sloped along the fascia board F so that water contained therein is directed under the influence of gravity toward one end of the gutter 16. In this regard, the illustrated portion of the gutter 16 is only one segment of the gutter 16 illustrated for illustrative purposes and in use would be coupled to adjoining, similarly configured gutter segments—the segments could be integrally formed—so that the overall gutter 16 is generally coextensive with the span of the roofline. Similarly, in one manner known in the art, the gutter assembly 12 preferably further includes down spouts (not shown) coupled to the lowest-most segment of the gutter 16 and in fluid communication therewith so that water directed through the gutter 16 drains down the down spout to a desired spill way for funneling the water to a desired location away from the foundation of the building B. However, the configuration of the gutter assembly 12 is not important, and any suitable gutter configuration can be utilized in the present invention, so long as the gutter is open at its top end for receiving water running off of the building's roof.

Turning now to FIGS. 1–5, the cover assembly 14 is coupled to the gutter 16 and extends over the gutter 16 and the roofline RL in a covering relationship therewith, to siphon water into the gutter 16 while substantially preventing undesired debris from entering the gutter assembly 12. The illustrated cover assembly 14 broadly includes a one piece screen 20 and a plurality of fluted perforations 22 formed in the screen 20. In more detail, the illustrated screen 20 is generally S-shaped and defines an upper guard section 24, a bull-nose ledge 26, an intermediate siphoning section 28, a secondary bend 30, and a lower drainage section 32. The illustrated upper guard section 24 is a generally flat, solid sheet that is configured to extend from the second course of shingles S2 out over the roofline RL. The guard section 24 preferably extends out over a majority of the gutter 16 so that debris that is moving down the roof R and over the guard section 24 is directed out over the gutter 16 where the debris is free to fall to the ground. In this regard, the guard section 24, as well as the rest of the screen 20—is preferably formed from a relatively smooth material with a relatively low coefficient of friction that facilitates the debris sliding off of the upper guard section 24. Additionally, the guard section 24, as well as the rest of the screen 20, is preferably formed from a material that is sufficiently strong and durable to withstand exposure to various weather conditions. One suitable material is aluminum, such as aluminum that is commonly used for down spouts and having a similar thickness to that utilized in traditional down spouts.

The upper guard section 24 is preferably configured so that substantially all water running off of the roof R engages the guard section 24 and is thereby directed toward the downstream siphoning and drainage sections 28,30 before entering the gutter assembly 12. In this regard, the illustrated guard section 24 is generally coextensive with, and thereby spans substantially the entire roofline RL. Additionally, the illustrated guard section 24 is devoid of any of the perforations 22 or other ingress for water. Further, the illustrated guard section 24 extends sufficiently up the roof R so that the upper edge can be slid over the first course of shingles S1 and under the second course of shingles S2. In this manner, when installed, the upper guard section 24 is in a covering relationship with the first course of shingles S1 and thus slopes in a down hill direction consistent with the slope of the roof R. However, the section 24 need not be installed under the second course S2, and could, for example, be installed under the first course of shingles S1 if there is sufficient space (e.g., on a wood or slate roof). It is important, however, that the section 24 cover the roofline RL. As indicated above, the guard section 24, as well as the rest of the screen 20, is preferably formed of aluminum. It is believed the use of aluminum provides an adhesion-like quality between the water and the metal that facilitates directing the water into the downstream intermediate siphoning section 28 as will be further detailed below. However, it is within the ambit of the present invention to use other materials such as various metals or metal coatings (e.g., zinc, etc.). Although less preferred, it is also within the ambit of the present invention to utilize materials such as vinyl, synthetic resins, etc.

The bull-nose ledge 26 is formed between, and interconnects, the upper guard section 24 and the intermediate siphoning section 28. The bull-nose ledge 26 cooperates with the upper guard section 24 to divert undesired debris away from the gutter assembly 12 and, for purposes that will subsequently be described, the ledge 26 predominately covers the fluted perforations 22 formed in the downstream siphoning and drainage sections 28,32. In more detail, and as shown in FIG. 2, the ledge 26 is formed by, and comprises, a smooth, corner-less bend in the screen 20 between the guard and siphoning sections 24,28. The bend 26 is preferably corner-less so that water running down the upper guard section 24 remains engaged along the bend 26 and is thereby directed onto the intermediate siphoning section 28. It is believed the majority of water contacting the guard section 24 will "adhere" to the bend 26 and naturally be pulled by gravity onto and along the intermediate siphoning section 26. However, during heavy flow periods, such as torrential down pours, some of the water running off of the guard section 24 may not follow the bend 26 and therefore may fall directly onto the lower drainage section 32 or even over the side of the gutter 16. Nonetheless, it is believed that utilizing a corner-less bend 26 greatly optimizes the amount of water being directed into and along the intermediate siphoning section 28, and in most weather conditions, will direct substantially all of the water toward the intermediate section 28.

The bend 26 is configured so that the intermediate siphoning section 28 slopes downhill and back toward the fascia board F—i.e., under the guard section 24—when the system 10 is installed. In this regard, the bend 26 preferably forms an angle between the guard and siphoning sections 24,28 of less than ninety degrees. In this manner, undesired debris that is carried down the upper guard section 24 continues over the ledge 26 and over the side of the gutter 16 rather than being drawn into the intermediate section 28. It is believed that debris generally does not "adhere" to the screen 20 as water does and thus is compelled to slide off of the ledge 26 rather than bending back into the intermediate section 28. For purposes that will subsequently be described, the ledge 26 preferably is positioned over the lower drainage section 32 so that the ledge 26 predominately covers the drainage section 32. Additionally, the ledge 26 is preferably positioned sufficiently near the outer edge of the gutter 16 so that the majority of the debris sliding off of the ledge 26 can carry over the side of the gutter 16 rather than falling down onto the lower drainage section 32. It is within the ambit of the present invention to utilize various alternative configurations for the upper guard section 24 and the adjoining bull-nose ledge 30, including configurations that eliminate both the upper guard section and the ledge altogether. For example, as further detailed below, when applying the principles of the present invention to a relatively steeply pitched roof, it may be sufficient to utilize only a single planar section of screen that includes the unique fluted perforations (detailed below). However, it is believed a guard section in combination with an adjoining ledge provide for optimum debris diversion relative to the gutter assembly and are therefore preferred.

The intermediate siphoning section 28 is downstream from, and adjoins, the bull-nose ledge 26 and is configured to siphon water through the screen 20 and into the gutter assembly 12. In more detail, the siphoning section 28 is a generally planar section including at least a portion of the plurality of the fluted perforations 22 formed therein. The section 28 presents an outer front surface 28*a* and an opposite inner rear surface 28*b* (see FIG. 2). As water runs over the ledge 26 and onto the intermediate section 28, the water engages—and "adheres" to—the outer front surface 28*a*. The unique configuration of the fluted perforations 22 will be described in detail below. However, it is important that with regard to the intermediate siphoning section 28, the perforations 22 are formed so that the channels, or flutes, recess into the outer front surface 28*a* and project out of the inner rear surface 28*b*. In this regard, and as will be further detailed below, water engaging the front surface 28*a* is directed, or siphoned, through the fluted perforations 22 where it is then free to drain into the open gutter 16. The intermediate siphoning section 28 slopes downhill between the ledge 26 and the secondary bend 30. It is important that the siphoning section 28 slopes in the generally opposite direction relative to both the upper guard section 24 and the lower drainage section 32. That is to say, the siphoning section 28 slopes toward the fascia board F while the guard and drainage sections 24,32 each slope away from the fascia board F. In this regard, debris sliding over the ledge 26 is generally prevented from engaging the front surface 28*a* and thus cannot clog the perforations 22 formed therein. It is believed that in operation, the substantial majority of water passing through the screen 20 into the gutter assembly 12 passes through the fluted perforations 22 formed in the intermediate siphoning section 28 (as opposed to the perforations 22 formed in the lower drainage section 32 as described below). However, as indicated above, it is within the ambit of the present invention in some applications (e.g., where the roof is sufficiently sloped), to utilize only a single planar section of screen that includes the unique fluted perforations, and thus an intermediate section would not be necessary. Nonetheless, the intermediate section 28 is strongly preferred given its high volume siphoning capacity coupled with the inability for debris to compromise the water from passing through the section 28.

The secondary bend 30 is formed between, and interconnects, the intermediate siphoning section 28 and the lower drainage section 32. The bend 30 cooperates with the bend 26 to position the siphoning and drainage sections 28,32 predominately under the bull-nose ledge 26. Additionally, the bend 30 facilitates directing water into the gutter 16. In more detail, and as shown in FIG. 2, the secondary bend 30 comprises, an abrupt bend in the screen 20 between the siphoning and drainage sections 28,32. Unlike the bend 26, the bend 30 is preferably abrupt to facilitate water draining from the back surface 28*b* of the siphoning section 28 to fall into the open gutter 16 rather than "adhering" to the lower drainage section 32. In this regard, the bend 30 is preferably spaced from the fascia board F when installed, to provide sufficient clearance for water to drain into the open end of the gutter 16 without draining between the backside of the gutter 16 and the fascia board F. The secondary bend 30 is also configured so that the lower drainage section 32 slopes at least slightly downhill and away from the fascia board F when the system 10 is installed. In this regard, the bend 30 preferably forms an angle between the siphoning and drainage sections 28,32 of less than ninety degrees. In this manner, water that is not siphoned through the fluted perforations 22 in the intermediate section 28 is directed under gravity onto and along the lower drainage section 32 where it passes through the fluted perforations 22 therein and into the gutter assembly 12. Further, the secondary bend 30 is preferably configured to cooperate with the bend 26 so that, as indicated above, the ledge 26 is positioned over the lower drainage section 32 so that the ledge 26 predominately covers the drainage section 32.

The lower drainage section 32 is downstream from, and adjoins, the secondary bend 30 and is configured to drain water through the screen 20 and into the gutter assembly 12. The drainage section 32 is a generally planar section including at least a portion of the plurality of the fluted perforations 22 formed therein. The section 32 presents an outer-most edge 32*a* and further includes a generally flat surface 34 adjacent the edge 32*a* and a bead 36 adjacent the surface 34. In more detail, the drainage section 32 is the lower-most section of the screen 20 and therefore any water that does not pass through the screen 20 at the siphoning section 28 drains through the fluted perforations 22 (detailed below) formed in the drainage section 32. The intermediate siphoning section 28 slopes at least slightly downhill between the bend 30 and the upper flat surface 18 of the gutter 16 so that water is directed under the influence of gravity towards the perforations 22 formed in the section 32. As indicated above, the bull-nose ledge 26 predominately covers the perforations 22 formed in the lower drainage section 32. As shown in FIG. 2, the ledge 26 does not cover all of the perforations 22, however, at least a majority of the perforations are positioned in the section 32 beneath the outer-most edge of the ledge 26. In this regard, if any debris falls onto the drainage section 32, it will likely land on the outer edge of the section 32, thereby leaving the majority of perforations 22 unaffected by the debris. As indicated above, it is believed that in operation, the substantial majority of water passing through the screen 20 into the gutter assembly 12 passes through the fluted perforations 22 formed in the intermediate siphoning section 28, however, any water that does not pass through the siphoning section 28 (e.g., water that falls off of the ledge 26 without "adhering" to the section 28, etc.) can drain through the screen 20 at the drainage section 32. The lower drainage section 32 preferably is configured to prevent water from running off of the drainage section 32 and over the flat surface 18 of the gutter 16. In the illustrated section 32, the bead 36 extends along the entire length of the section 32 and projects out of the section 32 adjacent the flat surface 34 to generally prevent water from draining off of the section 32.

The lower drainage section 32 of the screen 20 entirely covers the portion of the open end of the gutter 16 positioned between the secondary bend 30 and the upper flat surface 18 of the gutter 16. In this regard, the flat surface 34 of the section 32 is configured to engage the upper flat surface 18 of the gutter 16 when the cover assembly 14 is installed over the gutter assembly 12. In order to ensure the drainage section 32 remains in this covering relationship, the section 32 is preferably interconnected with the gutter 16. In the illustrated screen 20, the surface 34 of the drainage section 32 is screwed to the surface 18 of the gutter with a plurality of screws 38 (see FIG. 3). However, it is within the ambit of the present invention to utilize various alternative configurations for coupling the screen 20 to the gutter assembly 12, as well as not positively interconnecting the screen 20 to the gutter assembly 12 at all. One such preferred alternative interconnection is the clip connection 100 illustrated in FIG. 9. It will be appreciated that the screen 102 and the gutter 104 shown in FIG. 9 are identical to the screen 20 and gutter 16 previously described, with the exception of the clip connection 100. The clip connection 100 is configured to frictionally engage the edge of the gutter 104 to hold the screen 102 in position. The clip 100 can be formed during manufacturing to "snap" onto the edge of the conventional gutter 104 or the clip 100 can be bent around the edge of the gutter 104 during installation of the screen 102.

Returning now to the screen 20, and particularly to FIGS. 4–5, the fluted perforations 22 preferably comprise the only ingress for water to pass through the screen 20 and into the gutter assembly 12. As indicated above, the perforations 22 are distributed along the intermediate siphoning section and the lower drainage section 28,32. Particularly, the perforations 22 are preferably arranged in rows, with the perforations 22 of each row being offset relative to the perforations 22 in the immediately adjacent row as shown in FIG. 4. The fluted perforations 22 are each particularly configured to draw water through the screen 20 without allowing undesired debris through the screen 20. In more detail, each of the fluted perforations 22 includes a channel 40 recessed into the screen 20 and a corresponding hole 42 defined in the downhill end of the channel 40. As shown in FIG. 5, each of the channels 40 is recessed relative to the top, or front surface of the screen 20 and consequently projects out of the bottom, or back surface of the screen 20. The channels 40 are each shaped to present a tear drop-like appearance in plan view as shown in FIG. 4 and a diamond-like profile in elevation as shown in FIG. 5. Each of the corresponding holes 42 are formed in the downhill end of the respective channel 40. That is to say, the channels 40 are each formed in the screen 20 upstream relative to the respective hole 42 so that water running down the screen 20 first encounters the channel 40 where it is drawn into the downstream hole 42.

Each of the holes 42 is preferably sized and dimensioned to allow water to pass through but to prevent undesired debris from entering the hole 42. In this regard, each of the holes 42 is preferably generally round in shape and defines a diameter of less than or equal to one-eighth of an inch and most preferably three-thirty-seconds of an inch. It will be appreciated that some smaller debris, such as dirt particles and the like, will pass through the perforations 22 and into the gutter 16. However, the size of the perforations 22 necessarily limit such debris to relatively small debris that can easily drain through the gutter assembly 12 without undesirably accumulating to the point of clogging in the gutter assembly 12. In this regard, it can be said that such debris that can pass through the gutter assembly 12 without accumulating to the point of clogging therein is not "undesired" debris as that term is used herein. The configuration of the fluted perforations 22 and their arrangement in offset rows along the sections 28,32 present a "cheese grater" looking configuration for the perforations 22 in the screen 20. It is believed this cheese grater-like configuration facilitates drawing the water into the holes 42 so as to siphon the water through the screen 20.

It is believed this siphoning effect, in combination with the "adhesion" between the water and the metal screen, cooperate to enable the majority of water running down the screen 20 to pass through the perforations 22 in the intermediate section 28 even though it appears the water must run uphill to a degree to enter the holes 42 in the section 28. It is most preferred for the water to pass through the screen 20 at the intermediate section 28 because the perforations 22 located therein are the most protected from becoming clogged with debris. In this regard, the top row of perforations 22 on the intermediate section 28 is preferably positioned so that when the screen 20 is installed, this top row of perforations 22 is at or near the height of the drip edge DE (see FIG. 2). Although the perforations 22 can be positioned virtually anywhere on the screen 20, at least a majority of the perforations 22 are preferably positioned under the bull-nose ledge 26 to generally protect the perforations 22 from contacting debris washing off of the upper guard section 24.

It is believed that the unique design of the perforations 22 is sufficiently effective at siphoning water through the screen 20 without enabling undesired debris to enter the gutter assembly 12, that, as indicated above, it is within the ambit of the present invention in some applications (e.g., where the roof is sufficiently sloped), to utilize only a single planar section of screen that includes the unique fluted perforations. Nonetheless, the intermediate section 28 protected by the bull-nose ledge 26 is strongly preferred given the high volume siphoning capacity coupled with the inability for debris to compromise the water from passing through the section 28. It is also within the ambit of the present invention to utilize various alternative designs for the fluted perforations 22, including variously sized and shaped channels and holes. However, it is important that the perforations include channels on the uphill side of the hole and that the holes be sufficiently sized and dimensioned to generally prevent undesired debris from passing through the screen.

In operation, the gutter assembly 12 is affixed to the building B in any suitable manner. In this regard, it is not important that the gutter assembly 12 and cover assembly 14 be installed at the same time. For example, the cover assembly 14 could be installed as a modification to existing guttering. Next, the cover assembly 14 is coupled to the roof R and then interconnected to the gutter 16. In particular, the upper guard section 24 of the screen 20 is slid up under the shingles S, preferably the second course S2 until the bull-nose ledge 26 is located between the roofline RL and the outer edge of the gutter 16. The lower drainage section 32 is then interconnected to the gutter 16, for example, by screwing the surface 34 of the section 32 to the surface 18 of the gutter 16 with the screws 38. The positioning of the upper guard section 24 can be adjusted relative to the roof R to ensure the bends 26 and 30 are at the desired angles. In this regard, the screen 20 can be manufactured offsite, such as in uniform segments of a predetermined length (e.g., four foot, etc.) and placed end-to-end on the roof R in an overlapping relationship during installation. If desired, conventional flashing can be used to further seal between the segments of the screen 20. The configuration of the screen 20 enables the screen 20 to be manufactured in uniform segments that will fit most existing, conventional gutters (e.g., five inch, six inch, etc.) without modification. Alternatively, the screen 20 could be custom made onsite, for example from a coil stock of aluminum if desired.

Once the cover assembly 14 is installed, when rain water drains down the roof R, the water initially engages the upper guard section 24 of the screen 20. As the water drains down the section 24, the water will "adhere" to the screen 20 and bend around the bull-nose ledge 26. At this point, any undesired debris that is washing down the roof R with the water will fall over the ledge 26 and either drop to the ground or land on the outer edge of the lower drainage section 32 where the wind can ultimately blow the debris onto the ground. The water will then continue down the outer front surface 28*a* of the intermediate siphoning section 28 until it is drawn into the channels 40 of the fluted perforations 22 and into the holes 42. Once the water is siphoned through the perforations 22, it runs down the inner back surface 28*b* of the section 28 until it falls off of the bend 30 and into the open end of the gutter 16. Any water that does not enter the perforations 22 in the intermediate siphoning section 28 drains onto the lower drainage section 32 where it is drawn through the fluted perforations therein. Even if a relatively large amount of runoff water engages the lower drainage section 32, the water is held thereon by the bead 36 until the water can drain through the screen 20 and into the gutter 16. Once the water reaches the gutter 16, because no desired debris has been allowed into the gutter assembly 12, the water is directed down the down spouts and onto the spill way without restriction.

As indicated above, it is within the ambit of the present invention to utilize various alternative configurations for the gutter assembly and/or the cover assembly. One such alternative is the rain gutter cover system 200 illustrated in FIGS. 6–7. It will be appreciated that the system 200 is shown on a building similar in most respects to the previously described building B and accordingly the same reference letters will be utilized to indicate similar structure. However, the roof illustrated in FIGS. 6 and 7 is shown with a valley formed where two different sections of the roof intersect. In this regard, the valley V includes a conventional valley flashing VF overlying the tar paper and underlying the shingles as is commonly known in the art. The system 200 includes a gutter assembly 202 and a cover assembly 204. The gutter assembly 202 is similar to the previously described gutter assembly 12, however, the gutter assembly 202 is shown at a corner section under the valley. It should be noted that the corner section is a conventional L-shaped corner. The cover assembly 204 includes two roofline segments 206 and 208 and a valley segment 210 interposed between the segments 206,208. The segments 206,208 are virtually identically configured as the segment of the cover assembly 14 detailed above and therefore will not be further described in detail. The valley segment 210 includes a plurality of bull-nose ledges 212, 214, 216, 218 and 220, each guarding a plurality of fluted perforations 222. As shown in FIG. 7, the valley segment 210 extends over the roofline and at least partially up the valley where the segment 210 is sealed at its top edge to the valley flashing VF. The sides of the segment 210 preferably sit on the corresponding course of shingles with the next consecutive course of shingles being sealed over the sides of the segment 210. During installation, the sides of the segment 210 can be bent to mirror the slope of the valley if necessary, to enable the sides to engage the shingles. However, as shown in FIG. 7, at least the middle portion of the valley segment should be spaced from the valley flashing VF to allow sufficient clearance for water to drain under the valley segment 210. Although not shown, flashing can be inserted under the shingles and over the valley segment 210 to seal the segment 210 if desired.

Each of the bull-nose ledges 212,214,216,218,220 are configured similar to the ledge 26 previously detailed, however, the ledges 214,216,218,220 are more severely angled, or "compressed" than the ledge 212 and the previously described ledge 26. The fluted perforations 222 are virtually identical to the previously detailed perforations 22 and are predominately all guarded by the corresponding ledge 212,214,216,218,220. It will be appreciated that the ledges 214,216,218,220 operate in a manner similar to the previously described ledge 26 to separate the water from the undesired debris, however, these ledges simply dump the debris on to the next downstream drainage section. The lower drainage sections of the valley segment 210 are also somewhat different than the previously described section 32 in that the drainage sections along the valley are integrally formed with a corresponding guard section associated with the adjacent downstream ledge. The multiple bull-nose ledges 212,214,216,218,220 direct the water onto the intermediate sections where it is siphoned through the perforations 222 and onto the valley flashing VF. The undesired debris is simply deposited onto the various guard sections where it is either carried away by the wind or washed down over the lower-most ledge 212 and dumped over the edge of the gutter and onto the ground. Once the water is siphoned through the segment 210, it simply drains down the valley flashing VF and into the open gutter below. In this manner, the undesired debris is prevented from undesirably accumulating in the valley and then washing into the gutter below or obstructing the efficacy of the lower-most ledge 212.

Although the multiple, tiered bull-nose ledges as detailed above is preferred over the valleys in a roof, another suitable alternative valley configuration is shown in the rain gutter cover system 300 illustrated in FIG. 8. The system 300 utilizes a generally flat valley segment 302 with a single bull-nose ledge 304 adjacent the roofline. However, the segment 302 includes a plurality of fluted perforations 306 that siphon water through the screen 302 and onto the valley flashing below. The perforations 306 are virtually identical to the perforations 22 previously described and therefore generally prevent undesired debris from entering the gutter assembly 308 below. Unlike the corner gutter assembly 202 described above, the gutter assembly 308 includes an angled miter-boxed corner 310. The corner 310 includes an outer most edge 312 that, unlike the assembly 202, is non-perpendicular to the adjoining edges. In this manner, the gutter assembly 308 provides increased space between the fascia board and the gutter edge 312 for positioning the bull-nose ledge 304.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A rain gutter cover system for directing water running off a roof of a building into a gutter extending along the roofline while simultaneously preventing undesired debris from entering the gutter, said system comprising:

a screen adapted to couple to the gutter and being operable to extend from the roofline over the gutter in a covering relationship when the screen is coupled to the gutter so that substantially all water entering the gutter must pass through the screen, said screen including at least one section sloping downhill between the roofline and the gutter, when the screen is coupled to the gutter said at least one section sloping backward toward the building when the screen is coupled to the gutter to thereby form an acute angle with the roof, said at least one section presenting an outer surface facing the gutter when the screen is coupled to the gutter and an inner surface facing the building when the screen is coupled to the gutter, said outer surface being configured to direct water running off the building's roof into the gutter so that some water flows along said outer surface before entering the gutter when the screen is coupled to the gutter, said screen including an additional section extending from the roofline to the at least one section when the screen is coupled to the gutter, said additional section being configured to direct water running off the building's roof into the gutter so that some water flows over said additional section before entering the gutter when the screen is coupled to the gutter, said screen including a plurality of perforations formed therein for siphoning water through the screen and into the gutter, said perforations comprising the only means for water to pass through the screen, each perforation including a channel formed in the screen adjacent the perforation on the uphill side of the perforation for channeling water into the perforation, at least a portion of said plurality of perforations being formed in said at least one section, said channels of said at least a portion of said plurality of perforations being recessed relative to said outer surface and projecting out of said inner surface.

2. The system as claimed in claim 1, each of said perforations presenting a generally circular configuration and defining a diameter less than or equal to about one-eighth inch.

3. The system as claimed in claim 1, each of said at least a portion of said plurality of perforations cooperating with the corresponding channel to define a generally tear drop-shaped recession in the top outer surface.

4. The system as claimed in claim 1, said screen including a first section, a second section and a third section, said second section interconnected between said first and third sections and comprising said at least one section, said first section comprising said additional section.

5. The system as claimed in claim 4, said screen including a first bend spaced from the roofline and the gutter when the screen is coupled to the gutter, said first bend interconnecting said first and second sections and cooperating with said second section to predominately cover said third section.

6. A rain gutter cover system for directing water running off a building's roof into a gutter extending alone the roofline while simultaneously preventing undesired debris from entering the gutter, said system comprising:

a screen adapted to couple to the gutter and being operable to extend from the roofline over the gutter in a covering relationship when the screen is coupled to the gutter so that substantially all water entering the gutter must pass through the screen, said screen including at least one section sloping downhill between the roofline and the gutter, when the screen is coupled to the gutter said screen including a plurality of perforations formed therein for siphoning water through the screen and into the gutter, said perforations comprising the only means for water to pass through the screen, each perforation including a channel formed in the screen adjacent the perforation on the uphill side of the perforation for channeling water into the perforation, at least a portion of said plurality of perforations being formed in said at least one section, said screen including a first section, a second section and a third section, said second section interconnected between said first and third sections and comprising said at least one section, said screen including a first bend spaced from the roofline and the gutter when the screen is coupled to the gutter, said sections each being configured to direct water running off the building's roof into the gutter so that water flows along said sections before entering the gutter when the screen is coupled to the gutter, said first bend interconnecting said first and second sections and cooperating with said second section to predominately cover said third section, said screen including a second bend spaced from the roofline and the gutter when the screen is coupled to the gutter, said second bend interconnecting said second and third sections.

7. The system as claimed in claim 6, said first and second bends each being less than ninety degrees and cooperating so that each of the sections slopes downhill between the roofline and the gutter and each section is noncoplanar and nonparallel relative to each of the other sections.

8. The system as claimed in claim 7, said first section extending at least in part over the roof when the screen is coupled to the gutter and being devoid of perforations between the roofline and the first bend.

9. The system as claimed in claim 8, said third section being interconnected with the gutter when the screen is coupled to the gutter and including an additional portion of said plurality of perforations formed therein and positioned between said second bend and the interconnection with the gutter.

10. The system as claimed in claim 9, said third section including a bead formed therein and extending generally parallel to the gutter when the screen is coupled to the gutter, said bead being positioned between said second bend and the interconnection with the gutter and generally adjacent the interconnection with the gutter.

11. A rain gutter cover system for directing water running off a building's roof into a gutter extending along the roofline while simultaneously preventing undesired debris from entering the gutter, said system comprising:

a screen adapted to couple to the gutter and being operable to extend from the roofline over the gutter in a covering relationship when the screen is coupled to the gutter so that substantially all water entering the gutter must pass through the screen, said screen including a plurality of perforations formed therein for siphoning water through the screen and into the gutter, said perforations comprising the only means for water to pass through the screen, each perforation including a channel formed in the screen adjacent the perforation on the uphill side of the perforation for channeling water into the perforation, said screen including a first section, a second section and a third section, said sections each being configured to direct water running off the building's roof into the gutter so that water flows along said sections before entering the gutter when the screen is coupled to the gutter, said second section interconnected between said first and third sections and sloping downhill between the roofline and the gutter, when the screen is coupled to the gutter said screen including a first bend spaced from the roofline and the gutter when the screen is coupled to the gutter, said first bend interconnecting said first and second sections and cooperating with said second section to predominately cover said third section, said screen including a second bend spaced from the roofline and the gutter when the screen is coupled to the gutter, said second bend interconnecting said second and third sections, at least a portion of said plurality of perforations being formed in at least one said first, second, or third sections.

12. The system as claimed in claim 11, said first and second bends each being less than ninety degrees and cooperating so that each of the sections slopes downhill between the roofline and the gutter and each section is noncoplanar and nonparallel relative to each of the other sections.

13. The system as claimed in claim 12, said first section extending at least in part over the roof when the screen is coupled to the gutter and being devoid of perforations between the roofline and the first bend.

14. The system as claimed in claim 13, said second section comprising said at least one of said first, second, or third sections.

15. The system as claimed in claim 14, said third section being interconnected with the gutter when the screen is coupled to the gutter and including an additional portion of said plurality of perforations formed therein and positioned between said second bend and the interconnection with the gutter.

16. The system as claimed in claim 15, said third section including a bead formed therein and extending generally parallel to the gutter when the screen is coupled to the gutter, said bead being positioned between said second bend and the interconnection with the gutter and generally adjacent the interconnection with the gutter.

* * * * *